United States Patent [19]

Rochlitz et al.

[11] 3,955,978

[45] May 11, 1976

[54] ELECTROPHOTOGRAPHIC RECORDING MATERIAL

[75] Inventors: Jürgen Rochlitz, Breckenheim; Günter Schön, Wiesbaden, both of Germany

[73] Assignee: Hoechst Aktiengesellschaft, Germany

[22] Filed: Nov. 11, 1974

[21] Appl. No.: 522,740

[30] Foreign Application Priority Data

Nov. 12, 1973 Germany ..... 2356370

[52] U.S. Cl. ..... 96/1.5; 96/1.6; 252/501

[51] Int. Cl.[2] ..... G03G 5/06

[58] Field of Search ..... 96/1 R, 1 PG, 1.3, 1.5, 96/1.6; 252/501

[56] References Cited

UNITED STATES PATENTS

| | | | |
|---|---|---|---|
| 3,287,114 | 11/1966 | Hoegl | 96/1.5 |
| 3,384,488 | 5/1968 | Tulagin | 96/1.3 |
| 3,536,484 | 10/1970 | Dowden et al. | 96/1.5 |
| 3,546,085 | 12/1970 | Weinberger et al. | 96/1 PE |
| 3,598,582 | 8/1971 | Herrick et al. | 96/1.5 |
| 3,725,058 | 4/1973 | Hayashi et al. | 96/1.6 |
| 3,740,218 | 6/1973 | Contois et al. | 96/1.5 |
| 3,842,038 | 10/1974 | Lohr et al. | 96/1.5 X |

FOREIGN PATENTS OR APPLICATIONS

| | | | |
|---|---|---|---|
| 763,540 | 8/1971 | Belgium | 96/1.5 |
| 4,326,710 | 11/1968 | Japan | 96/1.6 |

OTHER PUBLICATIONS

Chadwell et al., "Photoconductor," IBM Tech. Discl. Bull., Vol. 14, No. 9, Feb. 1972, p. 2781.

*Primary Examiner*—Roland E. Martin, Jr.
*Attorney, Agent, or Firm*—James E. Bryan

[57] ABSTRACT

This invention relates to an electrophotographic recording material comprising an electrically conducting supporting material having thereon a photoconductive double layer of organic materials, said double layer being composed of a homogeneous, opaque, charge carrier-producing dyestuff layer and a transparent top layer of insulating material containing at least one charge-transporting compound, the transparent top layer comprising a binder and a charge-transporting aromatic compound with an extended $\pi$-electron system which is substituted by at least one substituted amino group, and the dyestuff layer comprising a condensation product of an aromatic aldehyde and a compound carrying an active methylene group.

13 Claims, 3 Drawing Figures

Figure 1:
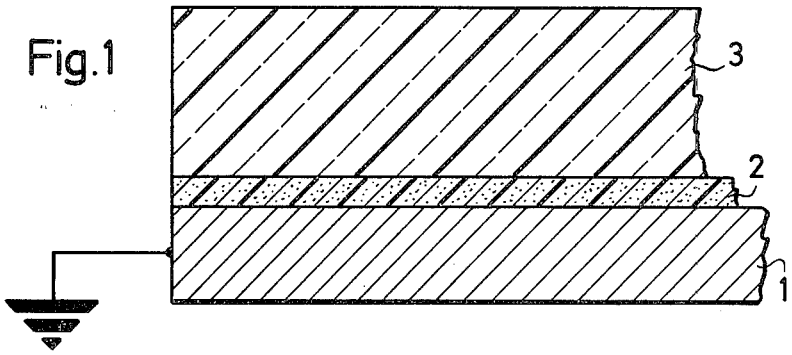

Formulae
(1)
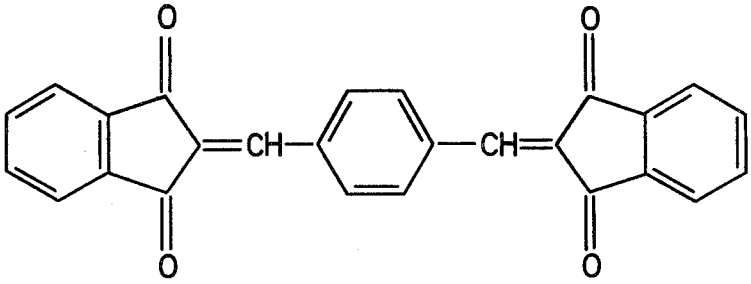
(2)
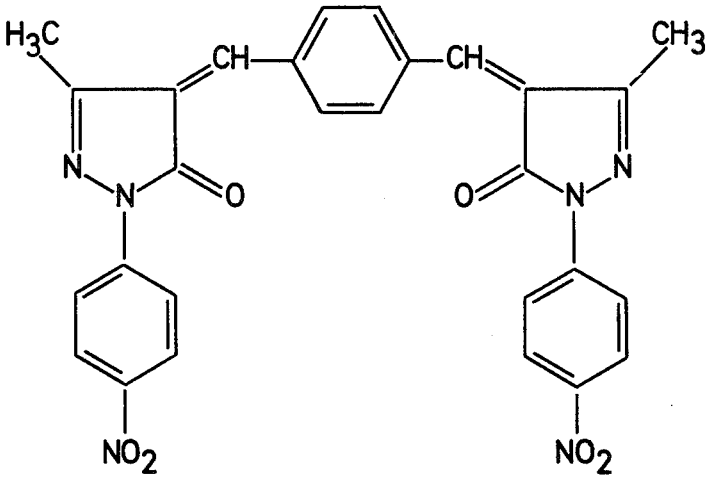

(3)
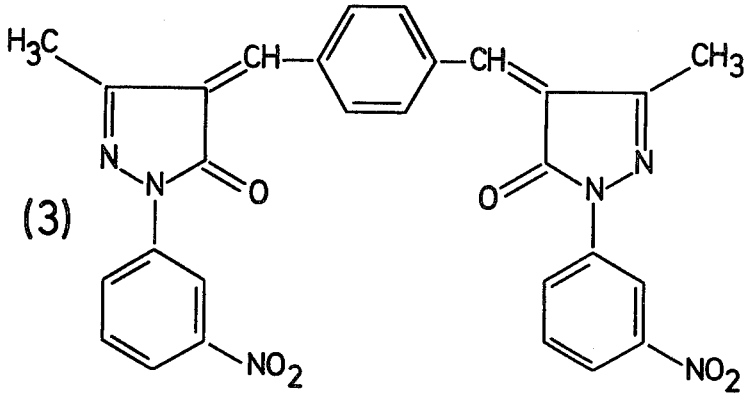
(4)
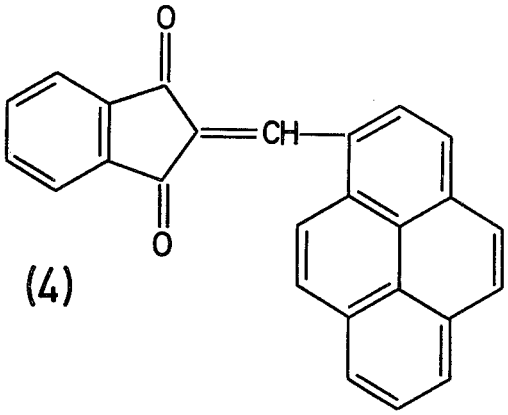
(5)
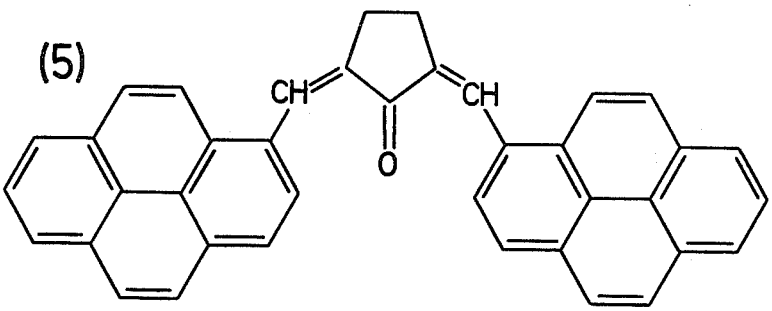

ELECTROPHOTOGRAPHIC RECORDING MATERIAL

This invention relates to an electrophotographic recording material comprising an electrically conducting supporting material having thereon a photoconductive double layer of organic materials, the double layer being composed of a homogeneous, opaque, charge carrier-producing dyestuff layer and a transparent top layer of insulating materials containing at least one charge-transporting compound.

It is known from German Offenlegungsschriften Nos. 1,597,877 and 1,797,342 to extend the spectral sensitivity of selenium layers in electrophotographic recording materials to the red spectral range by a double layer arrangement, using, e.g., pnthalocyanine dispersion layers. Such materials have the disadvantages that the vacuum deposition of selenium requires a high technical expenditure, that relatively thick selenium layers are brittle, that the heterogeneous components of the layers which are in contact with each other have only a poor adhesion, and that it is difficult to achieve a uniformly wetting coating of the respective dispersion solutions. Furthermore, no optimum light-sensitivities can be obtained because of the absorption behavior and the different charge conducting mechanisms of selenium and phthalocyanine contained in the double layer arrangement.

From U.S. Pat. No. 3,573,906, photoconductive double layer are known which contain an organic, possibly photoconductive insulating layer between the support and the vapor-deposited selenium layer to impart adhesion. A layer of this structure, however, considerably hinders the necessary charge transport so that, in this case also, the light-sensitivities obtained are not very high.

Furthermore, it is known from German Auslegeschrift No. 1,964,817 to coat vapor-deposited selenium layers with a layer of an organic, photoconductive, insulating material which is substantially insensitive to light in the visible range of the spectrum. Further, it also has been suggested, in German Offenlegungsschrift No. 2,120,912, to use such light-sensitive layer arrangements for electrophotographic recording materials which contain, as the charge carrier-producing layer, an inorganic material, such as the sulfide, selenide, sulfoselenide, or telluride of cadminum or zinc, and, as the charge carrier-transporting layer, an organic material containing at least 20 per cent by weight of 2,4,7-trinitro-9-fluorenone. Such layers with inorganic photoconductors have the disadvantage that during their production the conditions for the vapor-deposition of selenium must be exactly maintained and that the mixtures must be accurately adjusted in order to produce a satisfactorily photoconducting modification of the inorganic materials. Moreover, the adhesion of selenium to conductive support materials, such as aluminum, is insufficient. Due to fatigue after repeated charge/exposure cycles, the material cannot be used in electrophotographic copying machines.

Japanese Patent Application No. 43-26710 discloses photoconductive double layers of organic material disposed on an electrically conducting support. According to this application, a lower, relatively thick layer consisting of a highly diluted, homogeneous solution of a sensitizer in a binder is provided with a transparent, light-sensitive top layer. This layer construction, however, provides only a relatively insignificant increase in light-sensitivity which hardly meets technical requirements. According to another suggestion, made in German Offenlegungsschrift No, 1,909,742, a sensitizer solution is repeatedly poured over a ready-made photoconductive layer and the solvent is then evaporated. This process has the disadvantage that, as a result of the poor adhesion and cohesion of the applied sensitizer, the coated layer has only a low mechanical strength. Furthermore, repeated coating is cumbersome.

The composition of photoconductive double layers containing a dyestuff layer is also known, e.g. from Belgian Pat. No. 763,389 and 763,541, but in these materials top layers are used which render it impossible to produce sensitivities meeting very high requirements and which, furthermore, do not produce optimum adhesion between the dyestuff layer and the top layer, and thus are not sufficiently resistant to mechanical attack occurring, for example, in electrophotographic copying machines, especially during cleaning of the photoconductive layer.

It is the object of the present invention to provide a highly light-sensitive organic photoconductive layer for xerographic reproduction processes which is sensitive in a very wide range of the spectrum and which does not have the above described disadvantages. In particular, the adhesion between the different layers of the material should meet very high technical requirements, the material should show virtually no signs of wear or fatigue, and it should be quickly ready for further use after repeated application.

This object is achieved by an electrophotographic recording material comprising an electrically conducting supporting material having thereon a photoconductive double layer of organic materials, the double layer being composed of a homogeneous, opaque, charge carrier-producing dyestuff layer and a transparent top layer of insulating material containing at least one charge-transporting compound. In the material according to the invention, the transparent top layer comprises a binder and a charge-transporting aromatic compound having an extended $\pi$-electron system, which is substituted by at least one substituted amino group, and the dyestuff layer comprises a condensation product of an aromatic aldehyde and a compound containing an active methylene group. The dyestuff layer is composed of either a compoind having a terephthylidene group of the general formula

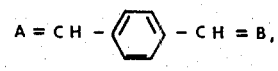

wherein A and B, which may be identical or different, represent a carbocyclic or N-heterocyclic five-membered ring which may be condensed with a benzene radical and is substituted by one or more oxo groups and possibly also by alkyl or aryl radicals, or of a cyclopentanone or cyclopentadione compound substituted by one or two pyrenylidene-(3)-radicals of the general formula

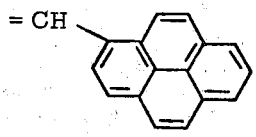

which may be condensed with a benzene radical.

The highly light-sensitive photoconductive double layers of the electrophotographic recording material of the invention, which have a high mechanical strength and may be mounted on a cylindrical drum, for example, or may be circulated in the form of an endless belt without exhibiting any special signs of wear, are thus very suitable for use in electrophotographic copying machines. The high light-sensitivity in a wide range of the spectrum is in particular due to the fact that the charge-transporting compound present in the transparent top layer is sensitized by the charge carrier-producing dyestuff layer in that the charge carriers, i.e. electrons or holes, migrate to the top layer.

In a preferred embodiment of the invention, the organic dyestuff layer has a thickness in the range from about 0.005 to about 2$\mu$m. In this manner, a high concentration of excited dyestuff molecules is produced in the dyestuff layer and at the boundary surface between the dyestuff and the top layer. The adhesion between the electrically conductive supporting material and the top layer is not impaired.

In a preferred embodiment, the transparent top layer has a thickness in the range from about 5 to about 20 $\mu$m. This assures a sufficiently high charge.

Suitable electrically conductive supporting materials are the materials hitherto used for this purpose, such as aluminum foils, or transparent or non-transparent plastic films to which layers of aluminum, tin, lead, antimony, or bismuth have been applied by vapor deposition or by lamination. The selection of the metal is determined by the sensitivities which can be obtained, the magnitude of the charge, and its stability during a plurality of copying cycles. Further, the type of support is determined by the manner in which it is to be used such as it if should be stiff, self-supporting, or flexible during use.

The homogeneous, opaque, charge carrier-producing organic layers according to the invention are dyestuff layers; for example the stilbene dyestuffs listed in the Table below are excellently suitable. They have the following designations:

1. Bis-(1,3-indandione)-2-terephthylidene (melting point 349°C, with decomposition)
2. Bis-[N-(p-nitrophenyl)-3-methyl-pyrazolone]-4-terephthylidene (melting point 340°C, with decomposition)
3. Bis[N-(m-nitrophenyl)-3-methyl-pyrazolone]-4-terephthylidene (melting point 336°C, with decomposition)
4. (3′-Pyrenylidene)-2-indandione-1,3 (melting point 247°C)
5. 2,5-Bis-(3′-pyrenylidene)-cyclopentanone-1 (melting point 306°C).

The spectral light-sensitivity of the photoconductive double layer according to the invention is mainly determined by the organic dyestuff layer. The organic dyestuff layer must be extremely uniform since it is its uniformity which guarantees a uniform injection of charge carriers into the top layer. In order to achieve this uniformity, the dyestuff layers are preferably applied by vapor-deposition of the dyestuff onto the support. In this manner, a tightly packed, homogeneous application is achieved.

This tightly packed coating renders it unnecessary to produce thick dyestuff layers in order to obtain a high absorption. The tight packing of the dyestuff molecules and the extremely low thickness of the layer allow the transport of charge carriers in a particularly advantageous manner, so that it is entirely sufficient to produce the charge carriers at the boundary surface only.

The high extinction of the dyestuff causes a high concentration of excited dyestuff molecules. Excitation (1) and charge separation (2) take place in the dyestuff layer according to the following equations:

$$1.\ S + h\nu \rightarrow S^x$$

$$2.\ S^x + S \rightarrow \cdot S^- + \cdot S^+$$

wherein

S stands for a dyestuff molecule, $S^x$ stands for an excited dyestuff molecule, and $\cdot S^-$ and $\cdot S^+$ are dyestuff radical ions.

At the boundary surface between the organic dyestuff layer and the transparent top layer, reactions of the excited dyestuff molecules, or of the resulting charge carriers in the form of dyestuff radical ions, with the molecules of the charge transporting compound in the top layer proceed according to the following equations:

$$3.\ S^x + F_1 \rightarrow \cdot S^- + \cdot F_1^+$$

$$4.\ S^x + F_2 \rightarrow \cdot S^+ + \cdot F_2^+$$

$$5.\ \cdot S^+ + F_1 \rightarrow S + \cdot F_1^+$$

$$6.\ \cdot S^- + F_2 \rightarrow S + \cdot F_2^-$$

wherein $F_1$ is a donor molecule, $F_2$ is an acceptor molecule, and $\cdot F_1^+$ and $\cdot F_2^-$ are, respectively, donor and acceptor radical ions.

The reactions 3 and 5 proceed particularly favorably when the $\pi$-electron system present in the top layer is a compound which, being a donor compound, is capable of easily releasing electrons. This is the case with 2,5-bis-(p-diethylamino-phenyl)-1,3,4-oxadiazole or polyvinyl carbazole, for example. Reactions 4 and 6 are preferably possible with a substance in the top layer which, as an electron acceptor, easily accepts electrons, such as 2,4,7-trinitrofluorenone or 3,6-dinitro-N-t-butyl-naphthalimide.

Due to the characteristic features of the invention it is sufficient for the efficiency of the dyestuff when, besides its intense absorption, it has only either electron-attracting substituents, such as $>C=O$, $-NO_2$, $-CF_3$, or electron-repelling substituents, such as $-NH_2$, $-N(alkyl)_2$, or $-O-alkyl$, depending upon whether it is preferably suitable for the reactions 3 and 5 or 4 and 6. In the material of the present invention, a particularly low expenditure of energy favors the transportation of the charge carriers within the tightly packed dyestuff layer according to the following reactions:

$$7.\ \cdot S^+ + S \rightarrow S + \cdot S^+ \text{ or}$$

$$8.\ S + \cdot S^- \rightarrow \cdot S^- + S.$$

In all conventional sensitizing processes, however, transport via the dyestuff molecules present in low concentration is impeded by their wide distance from one another.

Analogously, the charge transport proceeds in the top layer as follows:

$$9.\ \cdot F_1^+ + {}_{F1} \rightarrow F_1 + \cdot F_1^+ \text{ (p-conductive)}$$

$$10.\ \cdot F_2^- + {}_{F2} \rightarrow F_2 + \cdot F_2^- \text{ (n-conductive)}$$

As a practical consequence of reactions 1 to 10, the double layer arrangement is negatively charged when electron donors are present in the top layer, so that reactions 3, 5, 8 and 9 can proceed. On the other hand, layers containing electron acceptors in the top layer are positively charged, so that reactions 4, 6, 7 and 10 can proceed.

The transport top layer of organic, insulating materials comprising at least one compound capable of transporting electrical charges is described as follows:

The transparent top layer has a high electrical resistance and prevents the electric charge from flowing off in the dark. Upon exposure to light, it transports the charges produced in the organic dyestuff layer.

If a negative charge is to be applied, the transparent top layer preferably is composed of a mixture of an electron donor and a binder. On the other hand, when the electrophotographic recording material is to be used for positive charging, the transparent top layer advantageously is composed of a mixture of an electron acceptor compound and a binder.

Thus, in the transparent top layer charge-transporting compounds are used which are known as electron donors or electron acceptors. They are used together with binders or adhesives which are adapted to the charge transporting compound as regards charge transport, film forming properties, adhesion, and surface characteristics. In addition, conventional sensitizers or substances forming charge-transfer complexes may be present. Such compounds may be used only insofar as they do not impair the necessary transparency of the top layer, however. Finally, other conventional additives, such as leveling agents, plasticizers, and adhesives also may be present.

Suitable compounds for charge transport are especially those organic compounds which have an extended $\pi$-electron system, such as monomeric and polymeric aromatic compounds.

Suitable monomers are especially those which contain at least one alkyl-substituted amino group. Heterocyclic compounds, such as the oxadiazole derivatives mentioned in German Pat. No. 1,058,836, have proved to be particularly suitable. They include, in particular, the 2,5-bis-(4′-diethylaminophenyl)-oxadiazole-1,3,4. Further monomeric electron donors which may be used are, for example, the triphenylamine derivatives, carbocyclic compounds, benzo-condensed heterocyclic compounds, pyrazoline or imidazole derivatives, as well as the triazole and oxazole derivatives disclosed in German Pats. Nos. 1,060,260 and 1,120,875.

Suitable polymers are, for example, polymeric aromatic vinyl compounds, such as polyvinyl anthracene, polyacenaphthylene, or copolymers of N-vinyl carbazole with styrene, vinyl acetate, or vinyl chloride. Poly-N-vinyl carbazole and copolymers of N-vinyl carbazole with an N-vinyl carbazole content of at least about 40 per cent by weight have proved to be particularly advantageous. Condensation products of formaldehyde with various aromatic compounds, such as the condensates of formaldehyde with 3-bromopyrene, also have proved suitable.

In addition to the compounds just mentioned, which predominantly have a p-conductive character, n-conductive compounds also may be used. These so-called electron acceptors are known, e.g., from German Pat. No. 1,127,218 and from German Offenlegungsschrift No. 2,059,540. Compounds such as 2,4,7-trinitrofluorenone and 3,6-dinitro-N-t-butyl-naphthalimide have proved to be particularly advantageous.

As regards flexibility, film forming properties, and adhesion, both natural and synthetic resins are suitable as binders. Examples of suitable binders are in particular polyester resins, e.g. those marketed under the name of "Dynapol" (Dynamit Nobel A.G., Troisdorf Bez. Cologne, Germany) and "Vitel PE 200" (Goodyear Tire & Rubber Co., Akron, Ohio, USA), which are copolyesters of isophthalic acid and terephthalic acid with glycol. Silicone resins, such as those marketed under the designation "SR" by General Electric Co. (of Schenectady, New York, USA), which represent three-dimensionally cross-linked phenyl-methyl siloxanes, have proved to be suitable. Further, copolymers of styrene and maleic anhydride, such as the products known by the name of "Lytron" (Monsanto Chemical Company, St. Louis, Mo., USA) are very suitable.

The mixing ratio of charge transporting compound and binder may vary. Relatively definite limits are given, however, by the requirement for maximum photosensitivity, i.e. the maximum proportion of charge transporting compound, and for the prevention of crystallization, i.e. as high as a proportion of binder as possible. A mixing ratio of about 1:1 parts by weight has proved preferable, but mixing ratios between about 3:1 and 1:4 or more also may be used in certain cases.

The conventional sensitizers to be additionally used may favorably influence the charge transport. Moreover, they may produce charge carriers in the transparent top layer. Suitable sensitizers are, for example: Rhodamine B extra (Schultz: "Farbstoffabellen" I, Vol. 7, 1931 edition, No. 864, page 365), Brilliant Green (NO. 760, page 314), Crystal Violet (No. 785, page 329), and Cryptocyanine (No. 927, page 397). For the same purpose as the sensitizers, substances may be added which form charge-transfer complexes with the charge-transporting compound. In this manner, a further increase of the photosensitivity of the described double layers may be achieved. The quantity of sensitizer or of the compound forming the charge-transfer complex, which is to be added, should be calculated so that the resulting donor-acceptor complex with its charge-transfer band is still sufficiently transparent for the light absorbed by the organic dyestuff layer beneath. Optimum concentration is at a molar donor/acceptor ratio of about 10:1 to about 100:1, and vice versa.

Besides the transparency of the top layer, its thickness is an important factor for the optimum photosensitivity of the material. As already mentioned, layer thicknesses between about 5 and about 20 $\mu$m are preferred. It was found, however, that the preferred range of thickness varies, depending upon whether monomeric or polymeric charge-transporting compounds are present in the binder. In the case of monomeric compounds, the preferred range includes thicker layers, whereas in the case of polymeric charge-transporting compounds thicknesses ranging from about 5 to about 10 μm are sufficient. Generally, with layers of a thickness of less than about 5 μm, maximum charges will be lower.

The mere addition of adhesives as binders to the charge-transporting compounds, especially polymeric compounds, already results in a good photosensitivity. Low molecular weight polyester resins, such as "Adhesive 49,000" (a product of DuPont de Nemours Co., Inc., of Wilmington, Delaware, USA) has proved to be particularly suitable.

The top layers of the type described have the characteristic feature that they allow a high charge coupled with low dark discharge. Whereas in all conventional sensitizing systems an increase in the photosensitivity is connected with an increase in the dark current, this parallelity can be prevented by an arrangement according to the present invention. Thus, these layers may be used in electrophotographic copying machines operating a low copying speed and using lamps of very low energy, as well as in copying machines operating at high copying speeds and using correspondingly higher lamp energies.

Figure 2:
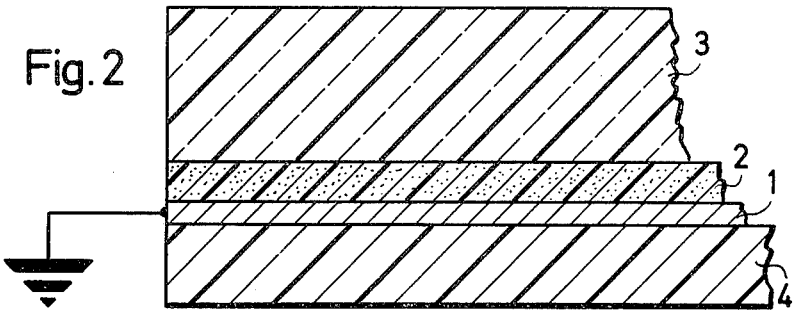
Figure 3:
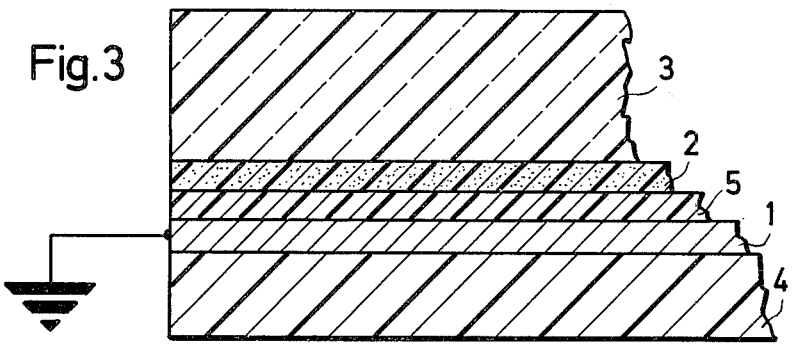

The accompanying drawings show diagrammatic representations of the electrophotographic recording material of the invention. In FIG. 1, the photoconductive double layer comprising the charge carrier-producing organic dyestuff layer 2 and the transparent top layer 3 composed of insulating, organic materials and containing at least one charge-transporting compound, is disposed on a metallic support 1, and in FIG. 2 the same double layer is disposed on a metallized plastic film 1, 4. The recording material shown in FIG. 3 contains an additional barrier layer 5 which prevents an injection of charge carriers in the dark.

It was found that the use of the above-mentioned dyestuffs in the dyestuff layer 2 and of the charge-transporting compound having an extended $\pi$-electron system, e.g. 2,5-bis-(4′-diethylaminophenyl)-oxadiazole-1, 3, 4, in the transparent top layer 3, on an electrically conducting support 1, produces a considerable increase in light-sensitivity, as compared with a single-layer coating of the compound contained in the top layer 3.

The electrophotographic recording material according to the invention is prepared by coating the electrically conducting support with a lower dyestuff and covering it with a transparent top layer of insulating organic materials containing at least one charge-transporting compound. As already mentioned, it has been found that the vacuum vapor-deposition of the dyestuff is particularly favorable.

In a preferred embodiment of the invention, the organic dyestuff is vapor-deposited on the electroconductive support at temperatures between 150° and 350°C under a vacuum of about $10^{-3}$ to about $10^{-6}$ mm Hg, preferably $10^{-3}$ to $10^{-4}$ mm Hg. Vapor-deposition must be homogeneous and takes place in as short a time as possible so that a gentle treatment of the dyestuff is ensured, even at relatively high temperatures.

The duration of vapor deposition depends upon various factors, such as the prevailing temperature, the pressure applied, and the vapor pressure of the dyestuff. A duration of about 10 minutes is possible, but it has been found that it is of advantage if the vapor deposition process proceeds as fast as possible and does not take more than about 2 to 4 minutes.

In selecting the dyestuff to be vapor-deposited, it is furthermore important that it should be capable of sublimation or evaporation without decomposition. Vaporization of the dyestuff may be caused by direct heating, but preferably by indirect heating of its surface or of its melt. The distance between the source of evaporation and the electrically conducting support should be so selected that the temperature of the support is as low as possible, preferably between 20° and 100°C. It may be of advantage to cool the support for this purpose.

The dyestuff layer is then coated with the top layer by a conventional method, for example by casting or by knife-coating of the solution, using readily volatile solvents or selecting the method such that rapid evaporation is ensured. Alternatively, the top layer may be applied by other conventional methods, such as lamination.

It has proved to be very advantageous to apply the coating with the aid of a slot die. In this manner, the period of contact between the solution and the dyestuff layer can be kept very short, if, for example, the support to be coated, which may be a web, is passed, shortly after the application of the solution, into a drying tunnel the temperature of which is in the range from about 60° to about 140°C, depending upon the length of the tunnel and the boiling point of the solvent.

Tetrahydrofuran, dioxane, and glycol monomethyl ether (methyl-glycol) have proved to be suitable as solvents for the described materials of the top layer. However, other known solvents also may be used which easily and rapidly dissolve the materials of the top layer.

The invention will be further illustrated by the following examples:

EXAMPLES

A. Preparation of the Dyestuffs

In the following, the well known method of condensing aromatic aldehydes in a weakly alkaline medium with compounds carrying active methylene groups will be described by reference to Dyestuff No. 5 of the Table:

23.0 g of pyrene-3-aldehyde are dissolved in the smallest quantity of dimethylformamide sufficient for dissolution, and 4.2 g of cyclopentanone are added. While the solution is still warm, 1.0 ml of pyridine and 1.0 ml of a 10 per cent solution of sodium methylate are added. The precipitating compound is washed with dimethylformamide and finally recrystallized from cyclohexanone.

Yield: 12.5 g

Melting Point: 306°C (cyclohexanone).

B. Preparation of the Layers

For the preparation of photoconductive double layers, the dyestuffs listed in the Table are vapor-deposited at a reduced pressure of $10^{-3}$ to $10^{-4}$ mm Hg. in a vacuum evaporator (type A 1, marketed by Pfeiffer, Wetzlar, Germany) on a 100 μm thick aluminum foil mounted at a distance of approximately 15 cm.

In the table, the vaporization times and temperatures are stated which are necessary to produce a uniform and sufficiently thick dyestuff layer.

In order to test the electrophotographic properties of the dyestuff layers, a top layer of 4 to 6 $\mu$m thickness composed of equal parts of 2,5-bis-(4'-diethylamino-phenyl)-oxadiazole-1,3,4 and "Lytron 820" (a styrene/maleic anhydride copolymer marketed by Monsanto) is applied by casting a 20 per cent tetrahydrofuran solution of the materials over the dyestuff layer. A similar photoconductive layer is then applied to an aluminum foil (zero layer).

In order to measure its photosensitivity, the photoconductive double layer is charged to the negative potentials given in the table ($U_o$ in volts) and then discharged by means of a xenon lamp of type XBO 150 which has an energy of about 300 $\mu$W cm$^{-2}$.

The photo-induced discharges are observed and measured by means of an electrometer of type 610 B (marketed by Keithley Instruments, USA), by the method described by Arneth and Lorenz in "Reprographie 3", 199, 1963. From these measurements, the half-life periods (T 1/2) stated in the Table are derived. A top layer which had been produced analogously, but without an underlying dyestuff layer (zero layer) was also measured for comparison purposes.

TABLE

Electrophotographic Sensitivities of Dyestuff Double Layers

| Dyestuff | Vapor Deposition Temp. °C | Vapor Deposition Time min. | $U_o$ −(V) | T½ msec |
|---|---|---|---|---|
| 1 | 190 | 2 | 980 | 150 |
| 1 | 190 | 4 | 990 | 95 |
| 2 | 360 | 2 | 820 | 70 |
| 2 | 360 | 4 | 810 | 70 |
| 3 | 290 | 2 | 900 | 205 |
| 3 | 290 | 4 | 1010 | 110 |
| 4 | 180 | 2 | 450 | 270 |
| 4 | 180 | 4 | 700 | 70 |
| 5 | 290 | 2 | 720 | 65 |
| 5 | 290 | 4 | 770 | 75 |
| — | — | — | 420 | >1000 |

It will be obvious to those skilled in the art that many modifications may be made within the scope of the present invention without departing from the spirit thereof, and the invention includes all such modifications.

What is claimed is:

1. Electrophotographic recording material comprising an electrically conducting supporting material having thereon a photoconductive double layer of organic materials, said double layer being composed of a tightly packed and uniform, homogeneous, opaque, charge carrier-producing dyestuff layer and a transparent top layer of insulating material containing at least one charge-transporting compound, the transparent top layer comprising a binder and a charge-transporting aromatic compound with an extended $\pi$electron system which is substituted by at least one substituted amino group, and the dyestuff layer comprising a condensation product of an aromatic aldehyde and a compound carrying an active methylene group, selected from the group consisting of a compound having a terephthylidene group of the general formula

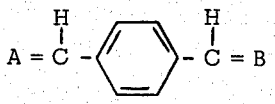

wherein A and B, which are identical or different, represent a carbocyclic or N-heterocyclic five membered ring which may be condensed with a benzene radical and is substituted by one or more oxo-groups and also may be substituted by methyl or a nitro-substituted phenyl radical and a cyclopentanone or cyclopentadione compound substituted by one or two pyrenylidene-(3)-groups of the following formula

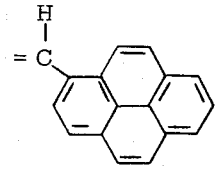

which additionally may be condensed with a benzene radical.

2. Electrophotographic recording material according to claim 1 in which the dyestuff layer comprises a compound having a terephthylidene group of the general formula

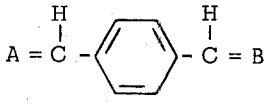

wherein A and B, which are identical or different, represent a carbocyclic or N-heterocyclic five membered ring which may be condensed with a benzene radical and is substituted by one or more oxo groups and also may be substituted by methyl or a nitro-substituted phenyl radical.

3. Electrophotographic recording material according to claim 1 in which the dyestuff layer comprises a cyclopentanone or cyclopentadione compound substituted by one or two pyrenylidene-(3) groups of the following general formula

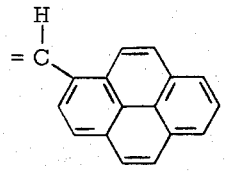

which additionally may be condensed with a benzene radical.

4. Recording material according to claim 1 in which the transparent top layer has a thickness in the range of about 5 to about 20 $\mu$m and the organic dyestuff layer has a thickness in the range of about 0.005 to about 2$\mu$m.

5. Recording material according to claim 1 in which the dyestuff layer is composed of bis-(1,3-indandione)-2-terephthylidene.

6. Recording material according to claim 1 in which the dyestuff layer is composed of bis-[N-(p-nitrophenyl)-3-methyl-pyrazolone]-4-terephthylidene.

7. Recording material according to claim 1 in which the dyestuff layer is composed of bis-[N-(m-nitrophenyl)-3-methyl-pyrazolone]-4-terephthylidene.

8. Recording material according to claim 1 in which the dyestuff layer is composed of (3′-pyrenylidene)-2-indandione-1,3.

9. Recording material according to claim 1 in which the dyestuff layer is composed of 2,5-bis-(3′-pyrenylidene)-cyclopentanone-1.

10. Recording material according to claim 1 in which the transparent top layer is composed of an approximately 1:1 mixture by weight of a charge-transporting compound and a binder.

11. Recording material according to claim 1 in which the charge-transporting compound is 2,5-bis-(4′-diethylaminophenyl)-oxadiazole-1,3,4.

12. Recording material according to claim 1 in which the transparent top layer contains a polymer or a copolymer having electron donor sub-units.

13. Recording material according to claim 7 in which the transparent top layer contains a condensate of formaldehyde and 3-bromopyrene.

* * * * *

UNITED STATES PATENT AND TRADEMARK OFFICE

CERTIFICATE OF CORRECTION

PATENT NO. : 3,955,978

DATED : May 11, 1976

INVENTOR(S) : Jürgen Rochlitz and Günter Schön

It is certified that error appears in the above-identified patent and that said Letters Patent are hereby corrected as shown below:

Column 1, line 17, "pnthalocyanine" should read - - - phthalocyanine - - -.

Column 3, line 26, the word "layer" should appear after "dyestuff".

Column 4, lines 17, 22, 30 to 36, 41, and the last two lines thereof, in all instances the "-" and "+" should read - - - ⊖ - - - and - - - ⊕ - - -, i.e., the upper case symbols.

Column 5, lines 7 through 10, the upper case symbols "-" and "+" should read - - - ⊖ - - - and - - - ⊕ - - -. Also, the letter "F" in all occurrences should be of uniform size as in the first occurrence. Line 19, "transport" should read - - - transparent - - -.

Column 7, line 21, "a" should read - - - at - - -. Line 48, the word "layer" should appear after "dyestuff".

Column 12, line 8, "claim 7" should state - - - claim 8 - - -.

Signed and Sealed this

Twentieth Day of July 1976

[SEAL]

*Attest:*

RUTH C. MASON
*Attesting Officer*

C. MARSHALL DANN
*Commissioner of Patents and Trademarks*